US009382909B2

(12) United States Patent
Hwang

(10) Patent No.: US 9,382,909 B2
(45) Date of Patent: Jul. 5, 2016

(54) REFRIGERATOR HAVING CENTRIFUGAL FAN-DUCT ASSEMBLY

(71) Applicant: Dongbu Daewoo Electronics Corporation, Seoul (KR)

(72) Inventor: Key Hwan Hwang, Incheon (KR)

(73) Assignee: DONGBU DAEWOO ELECTRONICS CORPORATION, Seoul (KR)

( * ) Notice: Subject to any disclaimer, the term of this patent is extended or adjusted under 35 U.S.C. 154(b) by 190 days.

(21) Appl. No.: 14/076,060

(22) Filed: Nov. 8, 2013

(65) Prior Publication Data

US 2014/0157812 A1 Jun. 12, 2014

(30) Foreign Application Priority Data

Dec. 11, 2012 (KR) ..... 10-2012-0143515

(51) Int. Cl.

| | |
|---|---|
| ***F25D 17/08*** | (2006.01) |
| ***F04D 17/04*** | (2006.01) |
| ***F25D 17/06*** | (2006.01) |
| ***F25D 21/14*** | (2006.01) |
| ***F04D 27/00*** | (2006.01) |

(52) U.S. Cl.

CPC ..... *F04D 17/04* (2013.01); *F04D 27/005* (2013.01); *F25D 17/062* (2013.01); *F25D 21/14* (2013.01); *F25D 2317/0681* (2013.01); *F25D 2317/0683* (2013.01)

(58) Field of Classification Search

CPC ..... F25D 17/08; F25D 21/14; F25D 17/062; F25D 1/00; F25D 11/00; F25D 17/00

USPC ..... 62/285, 419, 441

See application file for complete search history.

(56) References Cited

U.S. PATENT DOCUMENTS

| | | | | |
|---|---|---|---|---|
| 3,599,442 | A * | 8/1971 | Hanson | 62/239 |
| 3,630,046 | A * | 12/1971 | Boor | 62/408 |
| 3,667,249 | A * | 6/1972 | Brown et al. | 62/312 |
| 7,155,923 | B2 * | 1/2007 | Nam et al. | 62/259.2 |
| 7,237,402 | B2 * | 7/2007 | Hallin et al. | 62/407 |
| 8,850,839 | B2 * | 10/2014 | Park et al. | 62/262 |
| 2003/0034151 | A1 * | 2/2003 | Lopatinsky | F04D 25/166 165/122 |
| 2004/0107725 | A1 * | 6/2004 | Lee | 62/441 |
| 2005/0152781 | A1 * | 7/2005 | Baek et al. | 415/206 |
| 2007/0266727 | A1 * | 11/2007 | Bae et al. | 62/419 |
| 2008/0223063 | A1 * | 9/2008 | Jeong et al. | 62/291 |
| 2008/0245093 | A1 * | 10/2008 | Yoon et al. | 62/404 |
| 2010/0071875 | A1 * | 3/2010 | Hwang | F04D 29/422 165/80.3 |
| 2010/0139304 | A1 * | 6/2010 | Kim et al. | 62/291 |
| 2011/0011106 | A1 * | 1/2011 | Ahn et al. | 62/89 |
| 2011/0250065 | A1 * | 10/2011 | Liang | F04D 25/0613 415/212.1 |

* cited by examiner

*Primary Examiner* — Mohammad M Ali

(57) ABSTRACT

The present invention relates to a refrigerator having a centrifugal fan-duct assembly including a body having a storage room therein; and the centrifugal fan-duct assembly in the storage room, configured to separate a flow of cool air and a flow of defrosted water from each other, in order to prevent freezing in the cool air passage. Since the flow and/or directions of cool air and the defrosted water are different and/or separate from each other, the cool air passage is prevented from freezing.

15 Claims, 7 Drawing Sheets

PRIOR ART

PRIOR ART

REFRIGERATOR HAVING CENTRIFUGAL FAN-DUCT ASSEMBLY

BACKGROUND OF THE INVENTION

1. Field of the Invention

The present invention relates to a refrigerator having a centrifugal fan-duct assembly, and more particularly, to a refrigerator having a centrifugal fan-duct assembly which is capable of preventing freezing on a cool air passage of a centrifugal fan.

2. Background of the Related Art

Generally, a refrigerator is a household appliance configured to maintain low temperatures inside a cold storage space and a freezer through the repetition of a refrigeration cycle in which a refrigerant is compressed, condensed, expanded, and evaporated to maintain the freshness of food stored therein.

In general, the refrigerator includes a body partitioned into a cold storage space and a freezer (hereinafter, referred to as "storage room") in the interior of the refrigerator and doors on both sides of the body, configured to open and close the storage room.

With the improvement in the living standards of people, recently, refrigerators have been increased in size and quality. Accordingly, a side-by-side refrigerator with an enlarged storage capacity, has been widely supplied and used, wherein the inner space of the storage room is partitioned into left and right sides (e.g., the cold storage space and the freezer).

The side-by-side refrigerator has a centrifugal fan and a duct in the storage room configured to transmit cool air generated from an evaporator to the upper and lower sides of the storage room and to reduce the temperature deviation in the interior of the refrigerator in order to keep food in the storage room at a low temperature.

One conventional refrigerator duct assembly having the centrifugal fan is disclosed in Korean Patent Application Laid-Open No. 2006-0068761 (on Jun. 21, 2006), which will be discussed with reference to FIGS. 1 and 2.

As shown in FIGS. 1 and 2, a conventional refrigerator duct assembly 10 includes a fan cover 11 on the upper portion thereof and configured to face a centrifugal fan 17, holes 12 around the peripheral surface of the fan cover 11, and a duct 13 below the fan cover 11. Therefore, when the centrifugal fan 17 rotates, cool air generated from an evaporator (not shown) passes through the duct 13 to the storage room.

The duct assembly 10 has an inclined surface 15 at a portion where a front surface 14 of the duct 13 is connected to the fan cover 11. The inclined surface 15 allows the cool air introduced by the centrifugal fan 17 to gently move along the inclined surface 15 while flowing to the duct 13.

The inclined surface 15 has holes 16 therein, to prevent formation of a small vortex that may be generated on a bent portion where the fan cover 11 and the duct 13 are connected, thereby preventing the formation of frost when the cool air passes through duct 13.

However, in the conventional refrigerator duct assembly 10, frost may be formed on the centrifugal fan 17 itself in high humidity conditions, and the water resulting from a defrosting operation may drain downward along the duct 13.

As a result, the cool air and the defrosted water may cause the duct 13 to freeze, thereby interrupting the flow of the cool air that passes through the duct 13, and decreasing the cooling efficiency. In addition, the discharging holes on the duct 13 may be blocked or restricted with frost, and may undesirably cause the temperature in the interior of the refrigerator to deviate.

Therefore, there is a definite need for the development of a new refrigerator configured to have separate passages for the flow of cool air and the flow of defrosted water in order to prevent freezing in the cool air passage.

SUMMARY OF THE INVENTION

Accordingly, the present invention has been made in view of the above-mentioned problems occurring in the prior art, and it is an object of the present invention to provide a refrigerator having a centrifugal fan-duct assembly, configured to have separate passages for the flow of cool air and the flow of defrosted water, to prevent freezing of water in the passage where the cool air flows.

To accomplish the above object, according to the present invention, there is provided a refrigerator having a centrifugal fan-duct assembly, the refrigerator including a body having a storage room therein; and the centrifugal fan-duct assembly in the storage room, having separate passages for cool air and defrosted water.

According to embodiment(s) of the present invention, the centrifugal fan-duct assembly includes a centrifugal fan; a centrifugal fan mounting region, configured to accommodate the centrifugal fan; an upper passage communicating with an upper portion of the centrifugal fan mounting region; a lower passage communicating with a lower portion of the centrifugal fan mounting region; and a defrosted water passage in the lower passage, configured to discharge defrosted water therefrom.

According to embodiment(s) of the present invention, the lower passage extends downward in a direction of the cool air that blows from the centrifugal fan.

According to embodiment(s) of the present invention, an upper portion of the lower passage extends in a spiral or arc shape from one side of the centrifugal fan mounting region.

According to embodiment(s) of the present invention, the defrosted water passage is adjacent to an outer peripheral surface of the lower passage, and faces the centrifugal fan mounting region.

According to embodiment(s) of the present invention, the defrosted water passage is between a curved partition wall that surrounds a portion of the centrifugal fan mounting region and the inner peripheral wall of the lower passage.

According to embodiment(s) of the present invention, a discharging hole or vent in the upper portion of the lower passage, configured to communicate with the centrifugal fan mounting region and located at a position higher than that of the defrosted water passage.

According to embodiment(s) of the present invention, a center of the centrifugal fan is at a higher position than a lower end of the discharging hole or vent.

BRIEF DESCRIPTION OF THE DRAWINGS

The above and other objects, features and advantages of the present invention will be apparent from the following detailed description of various embodiments of the present invention in conjunction with the accompanying drawings, in which.

DETAILED DESCRIPTION

Hereinafter, an explanation of a refrigerator having a centrifugal fan-duct assembly according to the present invention will be given in detail with reference to the attached drawings.

Figure 1:
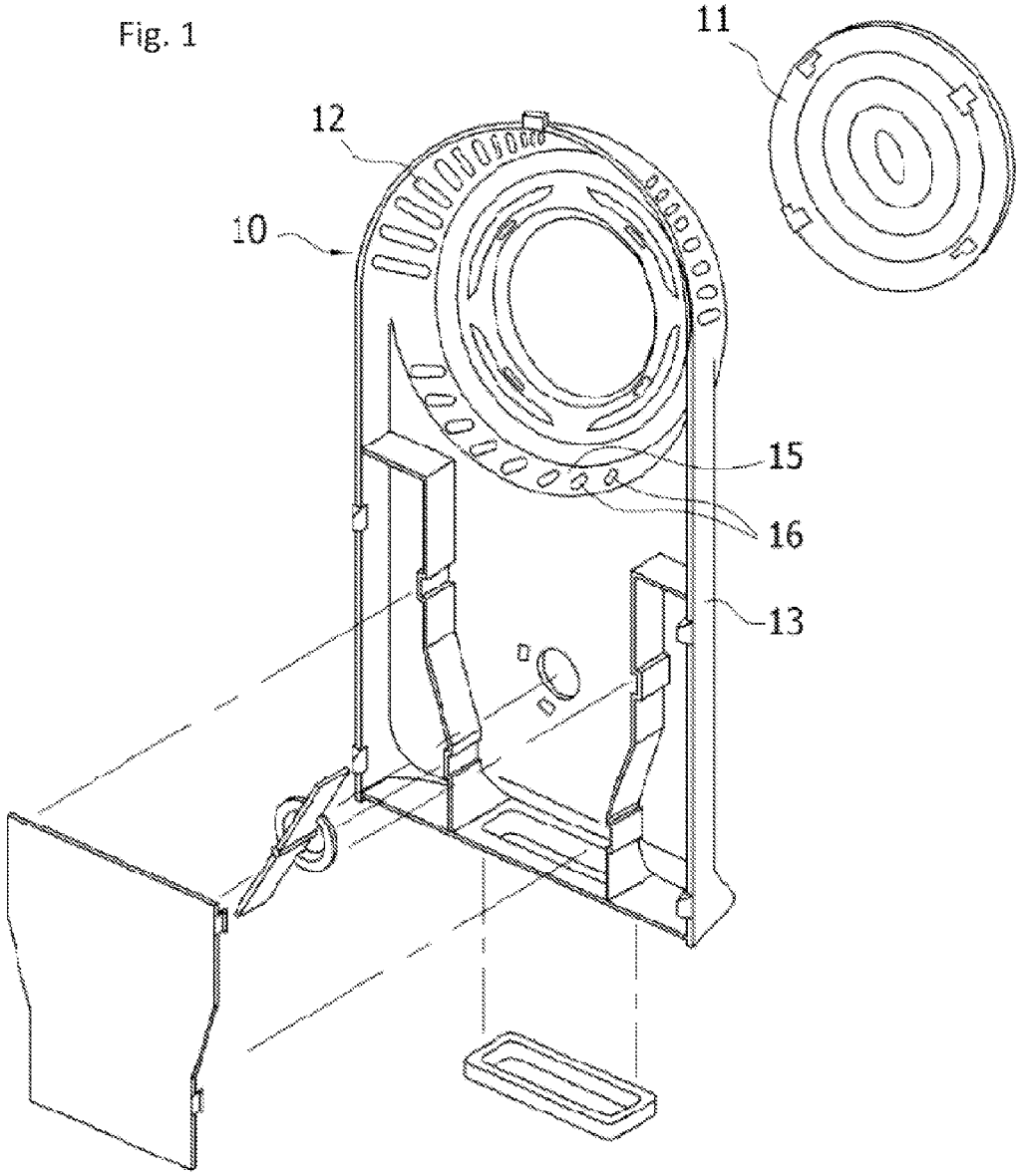
FIG. 1 is a perspective view showing a conventional centrifugal fan-duct assembly for a refrigerator.
Figure 2:
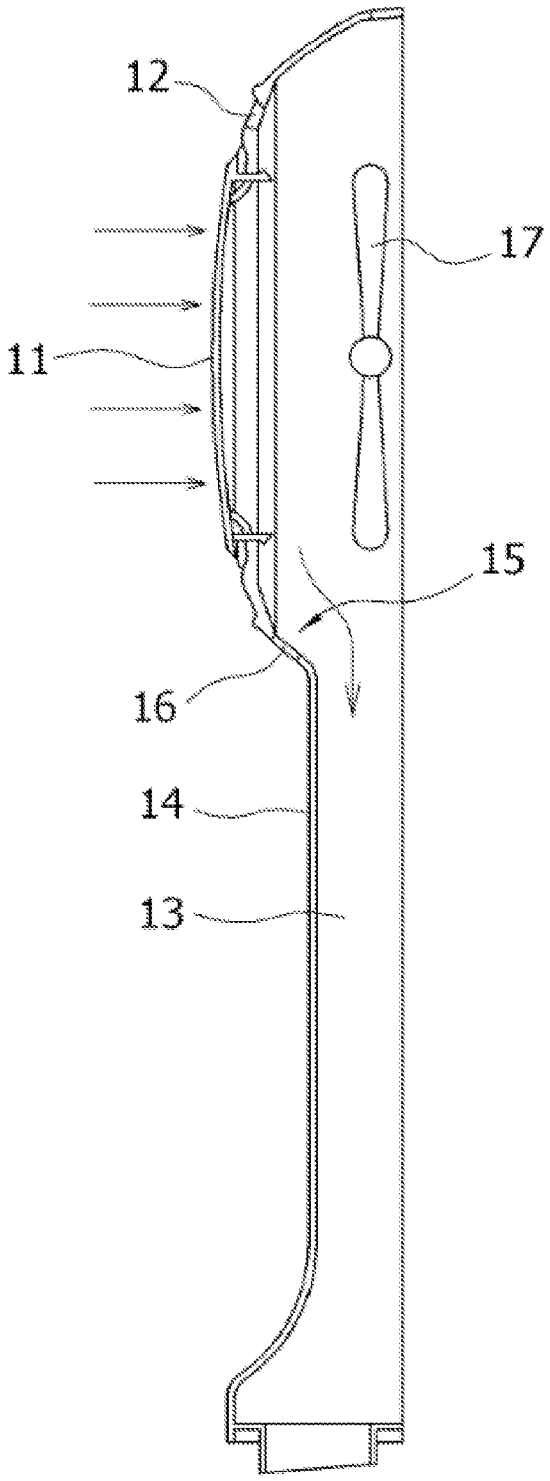
FIG. 2 is a cross-sectional view of the conventional centrifugal fan-duct assembly of FIG. 1.
Figure 3:
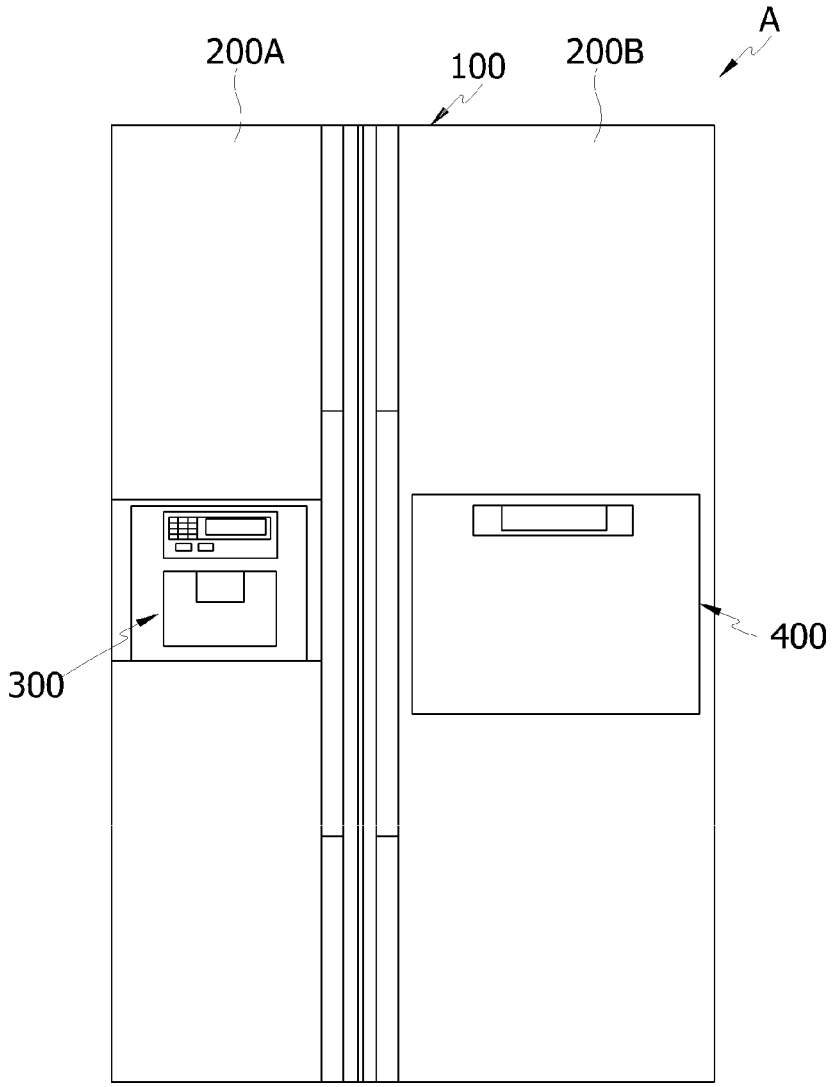
FIG. 3 is a front view showing an exemplary refrigerator having a centrifugal fan-duct assembly according to one or more embodiment(s) of the present invention.
Figure 4:
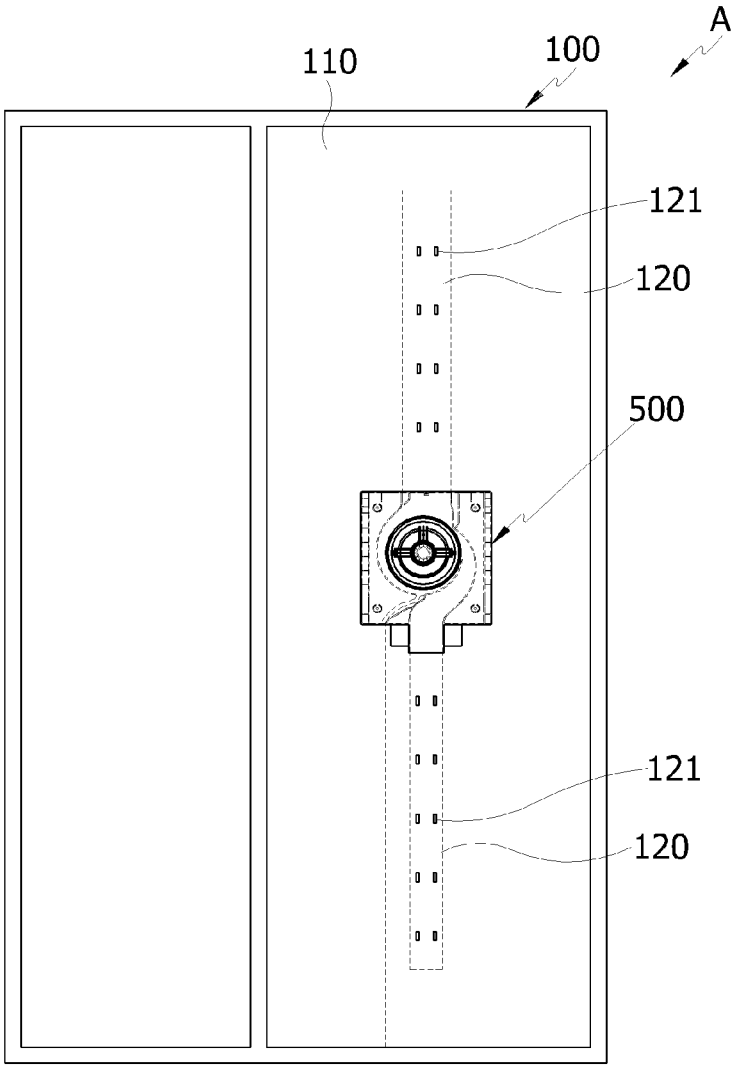
FIG. 4 is a front view showing the exemplary centrifugal fan-duct assembly in the refrigerator according to embodiment(s) of the present invention.
Figure 5:
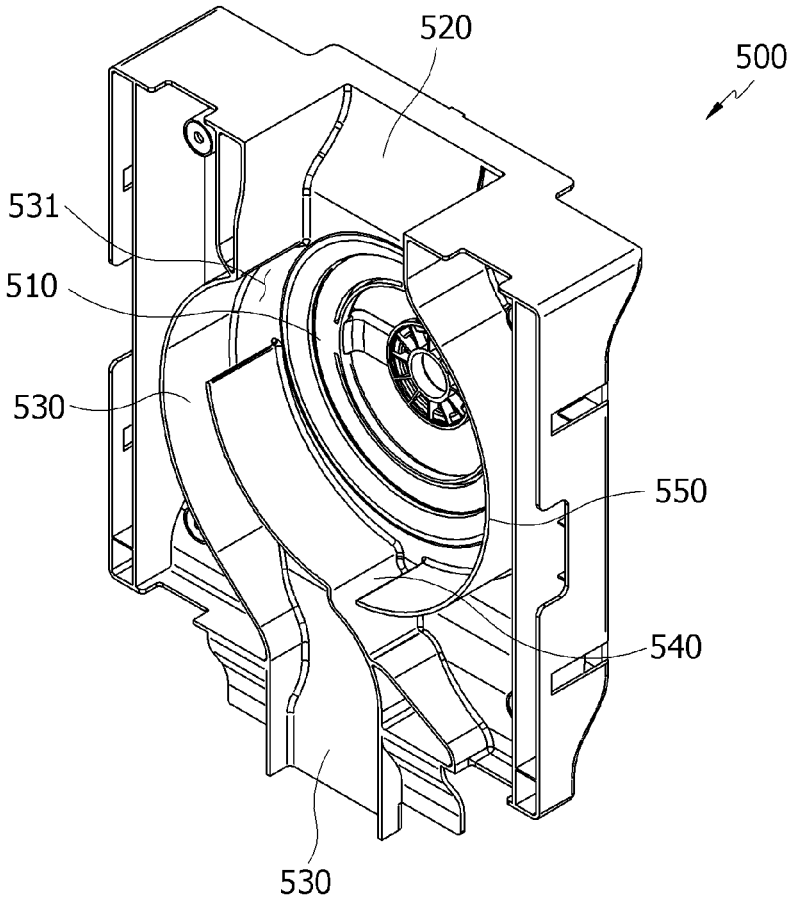
FIG. 5 is a perspective view showing a rear surface of the exemplary centrifugal fan-duct assembly in the refrigerator according to embodiment(s) of the present invention.
Figure 6:
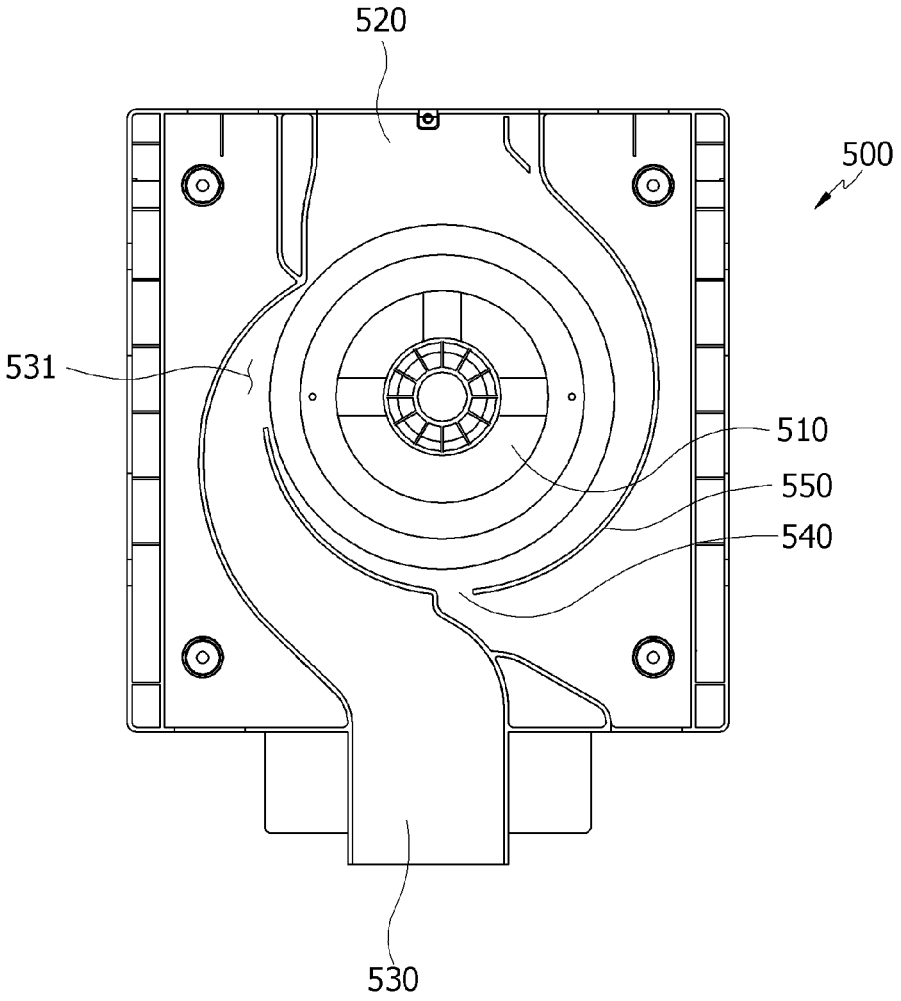
FIG. 6 is a rear view showing the exemplary centrifugal fan-duct assembly of FIG. 5 according to embodiment(s) of the present invention.
Figure 7:
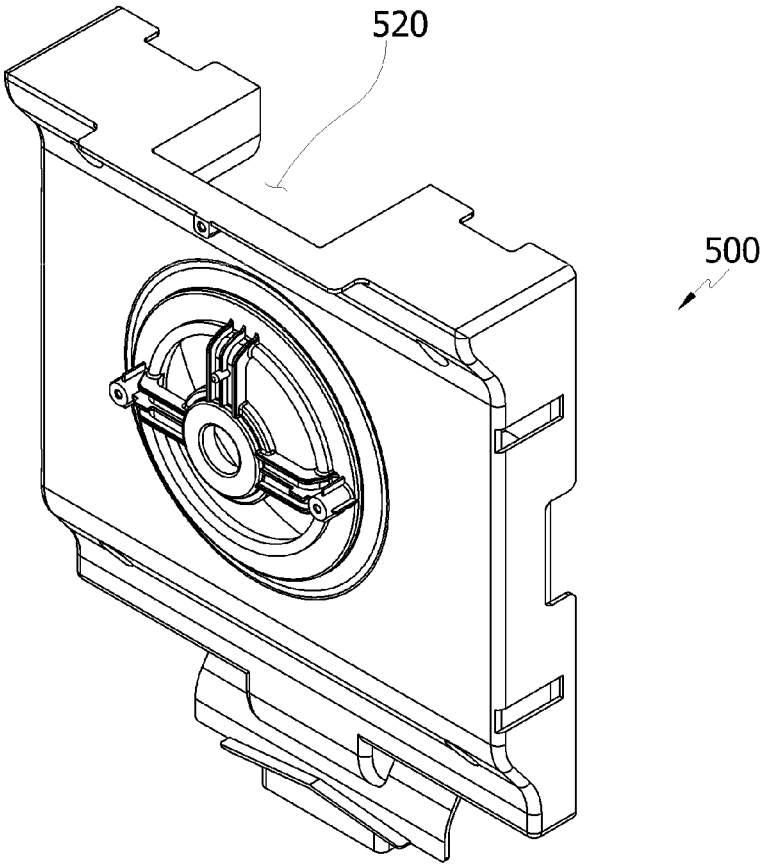
FIG. 7 is a perspective view showing a front surface of the exemplary centrifugal fan-duct assembly of FIG. 5 according to embodiment(s) of the present invention.

FIG. 3 is a front view showing an exemplary refrigerator having a centrifugal fan-duct assembly according to embodiment(s) of the present invention, FIG. 4 is a front view showing the exemplary centrifugal fan-duct assembly in the refrigerator according to embodiment(s) of the present invention, FIG. 5 is a perspective view showing a rear surface of the exemplary centrifugal fan-duct assembly according to embodiment(s) of the present invention, FIG. 6 is a rear view of the exemplary centrifugal fan-duct assembly of FIG. 5, and FIG. 7 is a perspective view showing a front surface of the exemplary centrifugal fan-duct assembly of FIG. 5.

Referring to FIGS. 3 and 4, first, an internal structure of a refrigerator according to the present invention will be explained, and the refrigerator A according to one or more embodiments of the present invention generally includes a body 100 having a storage room 110 divided into a cold storage space 110 and a freezer 120 (e.g., on left and right sides of refrigerator A, or in top and bottom directions); doors 200A and 200B on one side or both sides of the body 100, configured to open and close the storage room 110; and mechanical devices (not shown) such as a compressor, a condenser, and the like in a machine space in a lower portion of the body 100.

Furthermore, the refrigerator A includes a water dispenser 300 on the door 200A, configured to directly discharge and supply cold water to a user.

The refrigerator A also includes a home bar 400 on the door 200B for storing food or drinks in an inside pocket of the cold storage space.

In a side-by-side refrigerator, a centrifugal fan (not shown) supplies cool air upward and downward to decrease the deviation of temperature inside the storage room 110 and to improve the cooling efficiency of the refrigerator. The centrifugal fan is in a centrifugal fan-duct assembly 500 behind a rear wall (e.g., the inner case) of the storage room 110.

The centrifugal fan and the centrifugal fan-duct assembly 500 may be formed together, and may be installed behind the wall of the storage room 110.

A discharging passage 120 is in the storage room 110 and extends upward and downward from the centrifugal fan-duct assembly 500 to evenly discharge the cool air that is supplied from the centrifugal fan to the storage room 110. The discharging passage 120 has a plurality of holes 121 therein, configured to discharge cool air.

Hereinafter, the centrifugal fan-duct assembly 500 according to one or more embodiments of the present invention will be discussed in detail.

As shown in FIGS. 4 to 7, the centrifugal fan-duct assembly 500 according to embodiments of the present invention is configured to separate a flow of the cool air and a flow of the defrosted water from each other.

In more detail, the centrifugal fan-duct assembly 500 includes the centrifugal fan, a centrifugal fan mounting region 510, configured to accommodate the centrifugal fan, an upper passage 520 communicating with an upper portion of the centrifugal fan mounting region 510, a lower passage 530 communicating with a lower portion of the centrifugal fan mounting region 510, and a defrosted water passage 540 separate from the lower passage 530, configured to discharge defrosted water therefrom.

The lower passage 530 extends downward along the blowing direction of the centrifugal fan. Therefore, when the centrifugal fan rotates, the cool air is supplied gently to the storage room 110 through the lower passage 530.

T upper portion of the lower passage 530 extends in a spiral or arc shape from one side of the centrifugal fan mounting region 510, to allow the cool air to flow more gently.

The defrosted water passage 540 is adjacent to an outer peripheral surface of the lower passage 530 and faces the centrifugal fan mounting region 510 (e.g., below the centrifugal fan mounting region 510). Accordingly, the defrosted water that drips from the centrifugal fan and/or the centrifugal fan mounting region 510 moves or flows along the outer peripheral surface of the lower passage 530, and is discharged through the defrosted water passage 540.

The defrosted water passage 540 is between a curved partition wall 550 that surrounds a portion (e.g., a lateral portion) of the centrifugal fan mounting region 510 and the inner peripheral wall of the lower passage 530 facing the centrifugal fan mounting region 510. The defrosted water that drips from the centrifugal fan and/or the centrifugal fan mounting region 510 moves or flows along the curved partition wall 550 and the inner peripheral wall of the lower passage 530 and is gently discharged through the defrosted water passage 540.

Furthermore, a discharging hole 531 in an upper end of the lower passage 530, is configured to communicate with the centrifugal fan mounting region 510, and is located at a position higher than that of the defrosted water passage 540. As a result, the defrosted water generated during a defrosting operation is prevented from being discharged through the cool air discharging hole or vent 531.

Furthermore, the center (e.g., the rotation point) of the centrifugal fan is higher than a lower end of the discharging hole or vent 531. As a result, the cool air generated from the centrifugal fan can easily be discharged through the discharging hole or vent 531.

Accordingly, the cool air supplied from the centrifugal fan passes to the storage room 110 through the lower passage 530 and the upper passage 520. On the other hand, the defrosted water generated from the centrifugal fan moves or flows downward along the curved partition wall 550 and the inner peripheral wall of the lower passage 530, and is discharged through the defrosted water passage 540.

According to embodiments of the present invention, the lower passage 530 and the defrosted water passage 540 in the centrifugal fan-duct assembly 500 are separate from each other. As a result, the cool air and the defrosted water flow from the centrifugal fan mounting region 510 in different directions, separate from each other, thereby preventing the lower passage 530 from freezing or becoming blocked.

Furthermore, the freezing of the discharging passage 120 of the storage room 110 connected to the lower passage 530 can be prevented, and the temperature deviation in the interior of the refrigerator can be effectively reduced.

Therefore, frost generated on the centrifugal fan or in the centrifugal fan mounting region 510 in high humidity conditions, converted to water by the defrosting operation, is guided away from the lower passage 530, and discharged through the defrosted water passage 540, thereby preventing the lower passage 530 from freezing.

Through the defrosted water passage 540, the defrosted water is discharged and stored in a defrosted water dish (not shown) on or in the lower portion of the refrigerator.

As described above, the refrigerator according to embodiments of the present invention, separates the lower passage and the defrosted water passage in the centrifugal fan-duct assembly from each other. Thus, the cool air and the defrosted water flow in different directions, and the collection path of the defrosted water is separate from the distribution path of the cool air (e.g., the lower passage), thereby preventing the lower passage from freezing.

Therefore, frost generated on the centrifugal fan or in the centrifugal fan mounting region 510 in high humidity conditions, when converted to water by the defrosting operation, is guided away from the lower passage 530 and discharged through the defrosted water passage 540, thereby preventing the lower passage from freezing.

Accordingly, the refrigerator according to embodiments of the present invention is capable of maintaining its cooling efficiency and reducing the temperature deviation in the interior thereof.

The refrigerator according to embodiments of the present invention may be applied to the side-by-side refrigerators, and other various types of refrigerators, such as a single-door refrigerator, a kimchi refrigerator, a stacked refrigerator-freezer unit, and the like.

While the present invention has been described with reference to particular illustrative embodiments, it is not to be restricted by the described embodiments, but only by the appended claims. It is to be appreciated that those skilled in the art can change or modify the described embodiments without departing from the scope and spirit of the present invention.

What is claimed is:

1. A refrigerator having a centrifugal fan-duct assembly, the refrigerator comprising:

a body having a storage room therein; and the centrifugal fan-duct assembly in the storage room, configured to separate a flow of cool air and a flow of defrosted water from each other, wherein the centrifugal fan-duct assembly comprises:

a centrifugal fan;

a centrifugal fan mounting region, configured to accommodate the centrifugal fan;

an upper passage communicating with an upper portion of the centrifugal fan mounting region;

a lower passage communicating with a lower portion of the centrifugal fan mounting region; and a defrosted water passage divided from the lower passage and configured to discharge defrosted water, the defrosted water passage and the lower passage being extended from the centrifugal fan mounting region, wherein an upper portion of the lower passage extends in a spiral shape from one side of the centrifugal fan mounting region.

2. The refrigerator according to claim 1, wherein the lower passage extends downward in a same direction as the cool air that flows from the centrifugal fan.

3. The refrigerator according to claim 1, wherein the defrosted water passage is adjacent to an outer peripheral surface of the lower passage and configured to face the centrifugal fan mounting region.

4. The refrigerator according to claim 1, wherein the defrosted water passage is between a curved partition wall that surrounds a portion of the centrifugal fan mounting region and the inner peripheral wall of the lower passage.

5. The refrigerator according to claim 1, further comprising a discharging hole or vent in the upper portion of the lower passage, configured to communicate with the centrifugal fan mounting region, and located at a position higher than that of the defrosted water passage.

6. The refrigerator according to claim 5, wherein a center of the centrifugal fan is at a higher position than a lower end of the discharging hole or vent.

7. The refrigerator according to claim 1, further comprising upper and lower cool air discharging passages, in respective communication with the upper and lower passages, configured to supply cool air to the storage room.

8. The refrigerator according to claim 7, wherein the upper cool air discharging passage extends upward and the lower cool air discharging passage extends downward from the centrifugal fan-duct assembly.

9. The refrigerator according to claim 8, wherein the upper and lower cool air discharging passages each comprise a plurality of holes configured to evenly discharge the cool air to the storage room.

10. The refrigerator according to claim 1, wherein the lower passage is configured to pass the cool air generated from the centrifugal fan to a lower portion of the storage room.

11. The refrigerator according to claim 6, wherein the discharging hole or vent is at a predetermined location above the defrosted water passage, and the discharging hole or vent is configured to discharge the cool air.

12. The refrigerator according to claim 1, wherein the centrifugal fan-duct assembly is behind a wall of the storage room.

13. The refrigerator according to claim 1, wherein the storage room comprises a cold storage space and a freezer.

14. The refrigerator according to claim 6, further comprising doors on the refrigerator body, configured to open and close the storage room.

15. The refrigerator according to claim 9, wherein the centrifugal fan supplies cool air upward and downward, and the upper and lower cool air discharging passages decrease a temperature deviation in the storage.

* * * * *